United States Patent [19]

Thompson

[11] Patent Number: 4,561,543

[45] Date of Patent: Dec. 31, 1985

[54] PROTECTIVE ENCLOSURE FOR LIQUID-CONTAINING POUCHES

[75] Inventor: Kevin R. Thompson, Columbus, Ohio

[73] Assignee: Abbott Laboratories, North Chicago, Ill.

[21] Appl. No.: 678,307

[22] Filed: Dec. 5, 1984

[51] Int. Cl.[4] ..... B65D 81/02

[52] U.S. Cl. ..... 206/523; 206/587; 206/591; 220/23.8; 220/21

[58] Field of Search ..... 206/523, 584, 591, 587, 206/592, 593; 220/23.8, 20, 22, 21

[56] References Cited

U.S. PATENT DOCUMENTS

| | | | |
|---|---|---|---|
| 3,266,704 | 8/1966 | Deeren | 220/21 |
| 3,499,525 | 3/1970 | Kanter | 220/21 |
| 3,780,487 | 12/1973 | Munson | 206/587 |
| 3,961,708 | 6/1976 | Von Dohlen et al. | 206/289 |
| 4,026,457 | 5/1977 | Schubert | 220/23.8 |
| 4,241,829 | 12/1980 | Hardy | 206/523 |

*Primary Examiner*—Joseph Man-Fu Moy

*Attorney, Agent, or Firm*—Martin L. Katz; Margaret M. O'Brien

[57] ABSTRACT

A secondary package is provided for the purpose of enclosing and protecting a primary package in the form of a flexible pouch of liquid provided with access ports. The secondary package has internal divider ridges which distribute and dissipate the shock of impact, and at least one set of which is located nearer to the port end of the secondary package so as to protect the relatively vulnerable port area. Additional protective features of the secondary package include the use of a shock-absorbing material, and the provision of shock-absorbing flanges and spacer feet, and releasably locking detents for securing the secondary package in a closed condition.

12 Claims, 7 Drawing Figues

FIG. 1
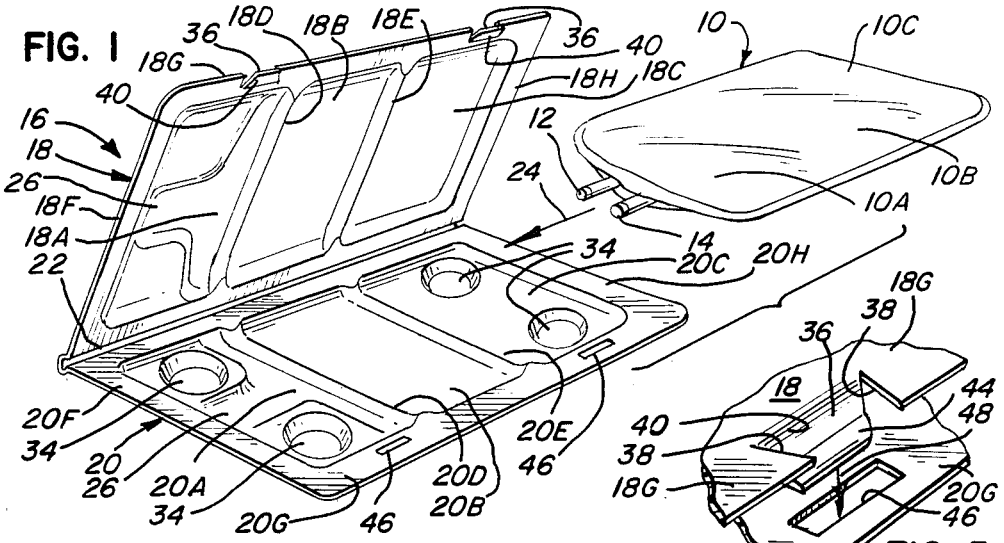
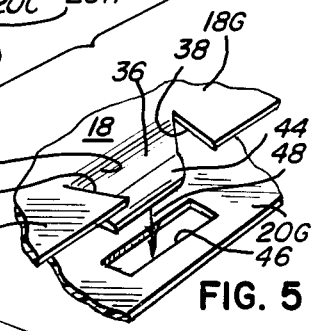
FIG. 5
FIG. 2
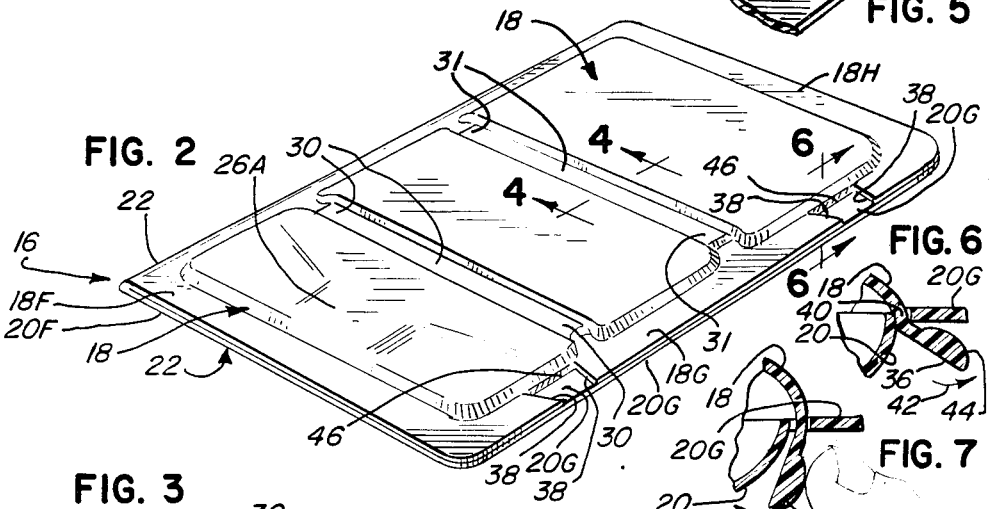
FIG. 6
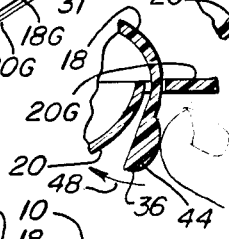
FIG. 7
FIG. 3
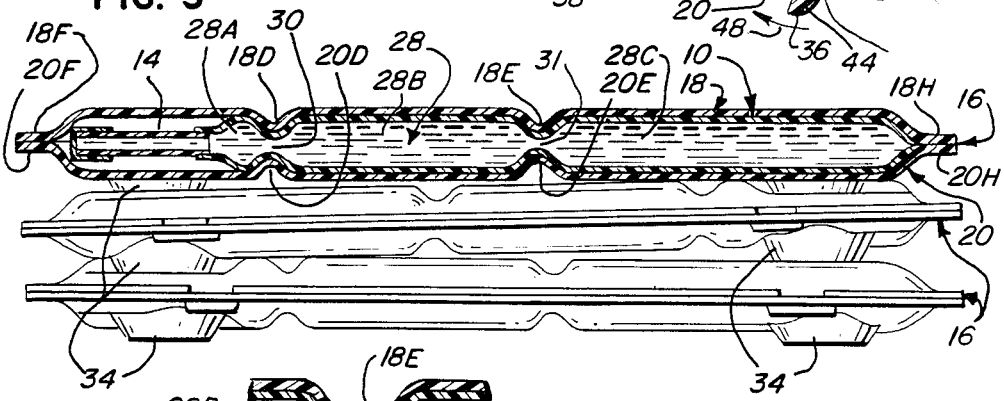
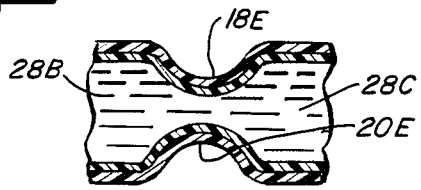
FIG. 4

PROTECTIVE ENCLOSURE FOR LIQUID-CONTAINING POUCHES

This invention relates generally to protective packaging; and is especially directed to a shell for protecting pouches containing liquids .

BACKGROUND

In recent years rigid containers have been replaced by flexible plastic pouches as liquid containers in a number of fields. Among the liquids which can be packaged in such pouches are wine, blood, intravenous fluids, and enteral nutrition solutions.

With the switch to this new container material, some problems have been solved but others have been created. One of the most common liquid container materials, glass, is of course brittle and therefore subject to shattering upon sudden impact. Less brittle materials, such as metals and rigid or semirigid plastics, are less subject to shattering, but are often dented by impact. Flexible pouches, on tne other hand, yield upon impact and thus resist both shattering and denting.

But one of the advantages of rigid and semi-rigid materials is that they absorb much of the shock of impact; whereas flexible materials yield so readily that they permit most of the shock to be transmitted to the liquid contents. In at least some applications that is a serious practical problem for the package designer.

In the case of some liquid products, such as medical nutritionals or infusion fluids which are packaged in flexible pouches, each pouch is formed of two sheets of plastic material placed in overlying relationship and secured together along their edges by heat-sealing or the like. At one end of the pouch is a port which is designed to be punctured by a needle or other sharp implement, in order to gain access to the liquid inside. In addition, adjacent to that port there may be a second port designed to be punctured by a similar instrument in order to permit air to enter the pouch as the liquid is withdrawn through the first port.

The port area (i.e., the ports and their surrounding heat seals) is the most fragile part of such pouches. In the event of a sudden impact, the port area is most vulnerable to the resulting shock waves transmitted by the liquid medium contained in the pouch. Because of this fact, the port area is subject to damage even as a result of an impact imparted at a considerable distance from the port end thereof.

The seriousness of the problem is demonstrated by a recent study which showed that the safe free-fall distance of such pouches, when packaged in paperboard cartons, is only fifteen inches. Thus, an ordinary corrugated shipping carton does not provide adequate protection for shipment through normal distribution channels.

BRIEF SUMMARY OF THE INVENTION

In order to protect the port area of such a pouch (the primary package) from rupture in the event of a sudden impact, the present invention provides a secondary package which encloses the primary package and has certain unique features that minimize the amplitude of the shock pulse reaching the port end of the primary package in the event that such an impact strikes it at some distance from the port end.

In accordahce with this invention, there is provided a secondary package comprising enclosure means adapted to define an interior space and to enclose the primary package therein. Dividing means project inwardly into the interior space of the secondary package and are adapted to constrict the flexible primary package along at least one line which divides the liquid-containing volume of the primary package into at least two liquid volume segments. This results in opposition to the flow of the liquid from a second one of the liquid volume segments into a first one of the liquid volume segments when the pressure in the second liquid volume segment exceeds that in the first liquid volume segment. Consequently, in the event of an impact against the second liquid volume segment, the first liquid volume segment is at least partially protected from the resulting shock.

These and additional features, objectives and advantages of the invention will be more fully understood from the following detailed description of an illustrative embodiment, in conjunction with the accompanying drawings.

BRIEF DESCRIPTION OF THE DRAWINGS

FIG. 1 is a perspective view of a secondary package in accordance with the present invention, seen in its open condition, along with a liquid-containing primary package of the type with which the secondary package is intended to be used. The latter is in position to be inserted into the interior of the secondary package.

FIG. 2 is a perspective view of the same secondary package, seen in its closed condition.

FIG. 3 is an end elevational view of a number of such secondary packages stacked one upon the other. The top one of the secondary packages is shown in section to reveal the aforesaid primary package contained therein.

FIG. 4 is an enlarged fragmentary sectional view of the secondary package of FIG. 2 and the primary package therein, taken along lines 4—4 of the latter Figure.

FIG. 5 is an enlarged perspective view of the latching means of the same secondary package.

FIG. 6 is an enlarged sectional view of the same latching means, taken along lines 6—6 of FIG. 2, in which the latching means is seen in its closed condition.

FIG. 7 is another enlarged sectional view of the same latching means, also taken along the lines 6—6 of FIG. 2, in which the latching means is in the process of being released.

DETAILED DESCRIPTION OF THE PREFERRED EMBODIMENT

The principal objective of the invention is to protect a liquid-containing primary package 10 made of flexible material. As illustrated in FIG. 1, this package is a soft-sided pouch having walls formed of flexible plastic sheets, and containing a liquid. Two ports 12 and 14 are provided at one end of the primary package 10 for the purposes of withdrawing the liquid from and admitting air into the package respectively.

These ports, of conventional construction, are designed to be punctured intentionally by means of a suitable sharp instrument. As a result of this design, the ports cannot withstand pressure pulses beyond a certain upper limit, or they will be punctured unintentionally. It is quite possible that the limits of the ports may be exceeded as the result of the shock wave transmitted through the liquid contents of the package 10 when a severe impact strikes the walls of the package at any location.

The ability of the liquid contents to transmit such destructive pressure pulses is such that even if the impact occurs near the bottom end 10C of the package, nearly the full pressure amplitude of the shock wave will be transmitted to the top, or port end, 10A thereof. Consequently, the shock wave from such an impact will be exerted upon the vulnerable ports 12 and 14 despite the remoteness of the impact location.

Accordingly, the present invention provides a protective secondary package 16 which is designed to enclose the primary package and which has, among other advantages, the unique ability to prevent the full impact of such pressure pulses from reaching the ports.

This package 16 comprises a molded plastic shell or enclosure having upper and lower enclosure halves 18 and 20, respectively, which are hinged together along a flexure line 22. The two halves are preferably formed from a single sheet of semi-rigid plastic material joined along the flexure line, which thus forms an integrally molded hinge. For maximum shock-absorbing qualities, the preferred material for the secondary package 16 is polystyrene foam, which has the additional advantage of being easily molded into the desired shape by vacuum-forming a flat sheet of thermally softened stock.

The vacuum-forming dies employed, which are conventional in nature, are shaped so as to form a number of concavities on the mutually confronting surfaces of enclosure halves 18 and 20. Specifically, the lower or interior surface of the upper enclosure half 18 is formed with concavities 18A, B and C; while the upper or interior surface of the lower enclosure half 20 is formed with concavities 20A, B and C.

The enclosure halves 18 and 20 may be rotated around the hinge 22 into mutually confronting relationship, at which time the concavities 18A, B and C cooperate with concavities 20A, B and C, respectively, to form an interior space which is adapted to receive the primary package 10. Arrow 24 indicates the direction of motion of the primary package as it is inserted into this interior space between the enclosure halves 18 and 20.

The concavities 18B and C and 20B and C are roughly rectangular in shape, and the portions of the interior space of the secondary package 16 which they form are wide enough to accommodate the midsection 10B and the bottom end 10C of the primary package 10.

The concavities 18A and 20A, however, are adapted to receive the top or port end 10A of the primary package 10; and therefore these concavities taper rapidly toward the adjacent edge of the secondary package 16 to form narrow neck-shaped regions 26 just wide enough to accomodate the ports 12 and 14 of the primary package 10. For additional clarity of explanation, the convex area on the exterior surface of enclosure half 18 which corresponds to the neck regions 26 has been labeled 26A in FIG. 2.

Separating the concavities 18A and B from each other is a divider ridge 18D which is molded into the enclosure half 18 and projects into the portion of the interior space of the secondary package which is formed by those concavities. A similar divider ridge 18E is molded into the enclosure half 18 between concavities 18B and C. Corresponding divider ridges 20D and E are molded into tne enclosure half 20, and have a corresponding relationship to the concavities 20 A, B and C.

When the enclosure halves 18 and 20 are rotated about the integral hinge 22 into confronting relationship to close the seondary package 16 (as illustrated in FIG. 2), the divider ridges 18D and 20D are aligned in confronting relationship with each other. Divider ridges 18E and 20E are similarly aligned in confronting relationship with each other. These relationships are illustrated in the sectioned portion of FIG. 3, and also in the enlarged sectional view of FIG. 4.

Consequently, when the primary package 10 is received within the interior space 18ABC, 20ABC of the secondary package 16 and the enclosure halves 18 and 20 are closed thereabout, the confronting pairs of divider ridges deflect the flexible plastic sheets which form the walls of the primary package 10 and thereby compress the primary package along two lines defined respectively by locations 30 and locations 31 (FIGS. 2, 3 and 4). This causes the interior liquid-filled volume 28 of primary package 10 to be constricted along the entire lengths of these lines.

As a result, the liquid-filled interior volume 28 is divided into first and second liquid volume segments 28A and B respectively, partially separated by constriction locations 30, and a third liquid volume segment 28C which is partially separated from segment 28B by constriction locations 31. The liquid within the primary package 10 is able to flow from any one of the volume segments 28A, B or C to an adjacent one of these volume segments, since the liquid passageway is not entirely closed either at constriction locations 30 or constriction locations 31; but these constrictions do restrict the passage of liquid to some extent by slowing down the flow of liquid therethrough which occurs in response to a pressure differential between adjacent volume segments.

Therefore, if a sudden impact is delivered to the primary package 10 in the region of its midsection 10B, the resulting excess of liquid pressure in the second liquid volume segment 28B will cause some of the liquid in that segment to flow into the first volume segment 28A, thus relieving the stress on the marginal seams of the package 10 where the overlapping sheets are sealed together. But the passage of the liquid will be slowed, and the impact upon the ports 12 and 14 consequently reduced, by the increased resistance to liquid flow encountered at the constriction 30.

Similarly, if a sudden impact is delivered in the region of the bottom portion 10C, both of the constrictions 30 and 31 act as safety valves, relieving the excess pressure in the third volume segment 28C by allowing some of the liquid to flow from that segment into the second volume segment 28B, and from the second segment 28B to the first volume segment 28A. But in so doing, they also restrict the flow and thereby spread the impact upon the ports 12 and 14 over a greater time, relieving the stress on those ports by reducing the maximum instantaneous pressure amplitude of the shock pulse reaching the ports.

The only time the primary package 10 can be struck without the ports 12 and 14 being protected from shock by this liquid flow restriction feature is when the impact strikes the port end of the primary package, i.e., when it strikes the first interior liquid-filled volume segment 28A instead of the second or third volume segments 28B or C. In that case there is no constriction 30 or 31 located between the point of impact and the ports 12 and 14 which can integrate the resulting pressure pulse.

But the risk of this occurrence is minimized in the design of the secondary package 16 by placing the topmost constriction 30 close to the port end of the primary package. Thus constriction 30 is very near the point at which the width of the interior space 18A,B,C, 20A,B,C narrows to form the neck region 26.

Accordingly, almost all of the internal volume 28 of primary package 10 is comprised within the volume segments 28B and 28C, where the effects of any sudden impact will be mitigated by the liquid flow restrictions at locations 30, or locations 30 and 31. In addition, almost all of the external surface area of the primary package 10 is located between the uppermost restriction locations 30 and the bottom portion 10C of the package.

It follows that, as a matter of statistical probability, almost all of the impacts which occur will strike between constriction locations 30 and the bottom portion 10C, producing shock pulses which originate in the second or third volume segments 28B and C, from which they must cross one of more of the restriction locations 30 and/or 31 before they can impinge upon the vulnerable ports 12 and 14.

Accordingly, the liquid flow restriction feature of the secondary package 16 significantly reduces the vulnerability of the ports, and permits a number of primary packages 10, when enclosed by respective secondary packages 16, to be packed in ordinary corrugated cartons for shipment through normal distribution channels without undue risk of harm.

FIG. 3 illustrates the manner in which a number of such secondary packages 16, each containing a primary package 10, may be stacked vertically for packing within a conventional corrugated carton for shipment to customers.

Even if a severe blow does fall upon the port end 10A of the primary package 10, the fact that the liquid contained in the first volume segment 28A is able to escape through the constriction 30 helps to relieve the strain exerted against the ports 12 and 14. In effect, the impact is shared between the first volume segment 28A and the second and third volume segments 28B and C.

In addition to the important liquid flow restriction feature, the secondary package 16 has several other features which contribute to the protection of the primary package 10 during shipment. As noted above, the material of the secondary package is shock-absorbent, a fact which in itself has some tendency to blunt the impact of blows arriving from any direction.

In addition, the secondary package 16 is integrally formed with marginal flanges, including a front flange 18G and side flanges 18F and H on the upper enclosure half 18, and a front flange 20G and side flanges 20F and H on the lower enclosure half 20, all of which project outwardly from the package. They extend in three different directions all extending roughly parallel to the plane defined by the length and breadth of the package 16, and thus serve to blunt the impact of any blows which may arrive from those directions. This effect is aided by the fact that the marginal flanges, being integrally formed, are made of the same shock-absorbent material as the rest of the secondary package 16.

Furthermore, each package 16 is integrally formed with a plurality of spacer feet 34, one near each corner of the package, extending outwardly from the enclosure half 20 thereof, i.e., generally parallel to the thickness dimension of the respective packages 16. Enclosure half 20 is the one which is at the bottom half of each package 16 when they are stacked vertically in the manner illustrated in FIG. 3. Therefore, at such times the feet 34 extend downwardly and serve primarily to separate each package 16 from the one below it in the vertical stack. But in addition to this spacing function, the feet 34, especially since they, too comprise the same shock-absorbent material as the rest of the package 16, also help to cushion impacts arriving from the direction of the bottom of the vertical stack.

In order to secure the secondary package 16 in its closed condition for the purpose of retaining the primary package 10 therein, the secondary package is provided with integrally formed latching means. These include latching tabs 36 which are initially formed integrally with the front flange 18G of the upper enclosure half 18, but are subsequently struck therefrom by being severed from the flange along lines 38. See FIGS. 2 and 5. The tabs 36 remain hinged to the upper enclosure half 18 along integral flexure lines 40, FIGS. 1 and 6, which are formed in such a way that they exert a biasing force tending to rotate each tab 36 about its hinge line 40 in the direction indicated by the arrow 42 in FIG. 6. In addition, the tabs are integrally formed with latching projections 44, which extend outwardly from the tabs in the same direction as that indicated by the arrow 42.

The tabs extend from the upper enclosure half 18 in the general direction of the lower enclosure half 20, as seen in FIG. 5, and are aligned with respective detent openings 46 formed in the front flanges 20G of the lower enclosure half 20. The openings 46 are sized to receive the tabs 36, and the latter may therefore be inserted into the detent openings 46 as indicated by the arrow 48 in FIG. 5 when the enclosure halves 18 and 20 are rotated about the integral hinge 22 into their closed position.

The breadth of the detent openings 46 is no greater than necessary to admit the latching projections 44, and after insertion, the biasing force exerted by the integral hinges 40 on the latching tabs 36 (represented by the arrow 42 in FIG. 6) causes the latching projections to be releasably detained by the adjacent margins of their associated detent openings so as to keep the enclosure halves 18 and 20 in closed relationship and thereby retain the primary package 10 inside the secondary package 16.

In order to release the latching tabs 36 and reopen the secondary package 16 so that the primary package can be retrieved therefrom, the user pushes against the tab in the direction indicated by arrow 48, so that the latching projections 44 are released from the adjacent margins of the detent openings 46. The tabs 36 can then be withdrawn from the openings 46, and the enclosure halves rotated back into their open position.

It will now be appreciated that the secondary package of this invention provides a shell which encloses and protects a liquid-filled pouch from the destructive effects of sudden impacts, and particularly from the harmful effects on the port area thereof which can result from impacts upon other portions of the pouch.

I claim:

1. For use with a primary package of flexible material defining an interior volume containing a liquid; a secondary package comprising:

enclosure means adapted to define an interior space and to enclose said primary package therein;

and dividing means projecting inwardly into said interior space of said secondary package and adapted to constrict said flexible primary package along at least one line which divides said liquid-containing volume of said primary package into at least two liquid volume segments in a manner to oppose flow of the liquid from a second one of said liquid volume segments into a first one of said liquid volume segments when the pressure in said second liquid volume segment exceeds that in said first liquid volume segment;

whereby, in the event of an impact against said second liquid volume segment, said first liquid volume segment is at least partially protected from the resulting shock.

2. A secondary package as in claim 1; wherein:

said dividing means are arranged to permit a restricted flow from said second liquid volume segment to said first liquid volume segment in response to said pressure excess;

whereby said shock is shared by both of said liquid volume segments as a result of said flow, but said shock to said first liquid volume segment is spread over time by said restriction of said flow.

3. A secondary package as in claim 1; wherein:

said line is located substantially nearer to one end of said secondary package interior space than to the other end thereof, so that said first liquid volume segment occupies a minor fraction of a selected dimension of said primary package, and said second and any other of said liquid volume segments together comprise a major fraction of said selected primary package dimension;

whereby said first liquid volume segment is at least partially protected from the shock resulting from an impact striking against any part of the majority of said liquid containing volume.

4. A secondary package as in claim 1; wherein:

there are a plurality of said dividing means adapted to divide said liquid-containing volume of said primary package into at least three of said liquid volume segments.

5. A secondary package as in claim 1; wherein:

said enclosure means is formed of shock-absorbent material.

6. A secondary package as in claim 5;

wherein said enclosure means defines a length, breadth and thickness, and further comprising:

means extending outwardly from said enclosure means in a direction substantially parallel to the plane defined by said length and breadth thereof;

whereby to provide additional cushioning for said primary package.

7. A secondary package as in claim 5, wherein said enclosure means defines a length, breadth and thickness; and further comprising:

means extending outwardly from said enclosure means in a direction substantially parallel to said thickness thereof;

whereby to provide additional cushioning for said primary package.

8. A secondary package as in claim 5; wherein:

said shock-absorbent material is compressable foam.

9. A secondary package as in claim 1; wherein:

said enclosure means comprises a shell including first and second halves;

each half being provided with a concavity;

and means hinging said halves together with their respective concavities in facing relationship;

whereby said concavities cooperate to form said secondary package interior space, and said interior space is openable to receive said primary package.

10. A secondary package as in claim 9; wherein:

said enclosure means halves and said hinging means are all integrally formed of a single piece of material;

said piece of material including an integral flexible junction along which said enclosure means halves meet, whereby to define said hinging means.

11. A secondary package as in claim 9; further comprising:

latching means on each of said enclosure means halves, interengaging to releasably retain said enclosure means halves in closed relationship;

whereby to retain said primary package within said secondary package.

12. A secondary package as in claim 11; wherein said latching means comprises:

detent means formed on one of said enclosure means halves;

tab means integrally formed on the other of said enclosure halves;

and integral flexible junction means hingedly connecting said tab means to said other enclosure half;

said tab means being integrally formed with projection means extending in a selected direction from said tab means;

said tab means and projection means being positioned and sized to be received within said detent means when said enclosure halves are in closed relationship;

said flexible junction yieldably biasing said tab means in said selected direction to urge said projection means toward a margin of said detent means so that said projection means is releasably detained by said margin;

whereby to releasably retain said enclosure means halves in closed relationship.

* * * * *